US009194576B2

(12) United States Patent
Jun

(10) Patent No.: US 9,194,576 B2
(45) Date of Patent: Nov. 24, 2015

(54) LED BULB WITH HEAT SINK

(71) Applicant: Xue Jun, Tingzhou (CN)

(72) Inventor: Xue Jun, Tingzhou (CN)

(73) Assignee: Component Hardware Group, Inc., Lakewood, NJ (US)

( * ) Notice: Subject to any disclaimer, the term of this patent is extended or adjusted under 35 U.S.C. 154(b) by 0 days.

(21) Appl. No.: 13/909,653

(22) Filed: Jun. 4, 2013

(65) Prior Publication Data

US 2014/0354136 A1 Dec. 4, 2014

(51) Int. Cl.

| | |
|---|---|
| ***F21V 29/00*** | (2015.01) |
| ***F21V 29/77*** | (2015.01) |
| ***F21K 99/00*** | (2010.01) |
| ***F21V 29/508*** | (2015.01) |
| *F21V 3/00* | (2015.01) |
| *F21Y 101/02* | (2006.01) |
| *F21V 29/85* | (2015.01) |
| *F21V 29/89* | (2015.01) |

(52) U.S. Cl.

CPC ..... *F21V 29/773* (2015.01); *F21K 9/1355* (2013.01); *F21V 29/508* (2015.01); *F21V 3/00* (2013.01); *F21V 29/85* (2015.01); *F21V 29/89* (2015.01); *F21Y 2101/02* (2013.01)

(58) Field of Classification Search

CPC ..... F21Y 2101/02; F21K 9/00; F21V 29/00; F21V 29/002; F21V 29/22; F21V 29/244

USPC ..... 313/46; 362/373, 249.02

See application file for complete search history.

(56) References Cited

U.S. PATENT DOCUMENTS

| | | | | |
|---|---|---|---|---|
| 2007/0149834 | A1* | 6/2007 | Endo et al. | 585/7 |
| 2009/0050925 | A1* | 2/2009 | Kuramoto et al. | 257/100 |
| 2009/0175041 | A1* | 7/2009 | Yuen et al. | 362/294 |
| 2009/0195186 | A1* | 8/2009 | Guest et al. | 315/294 |
| 2010/0026157 | A1* | 2/2010 | Tanaka et al. | 313/45 |
| 2010/0219735 | A1* | 9/2010 | Sakai et al. | 313/46 |
| 2010/0289396 | A1* | 11/2010 | Osawa et al. | 313/46 |
| 2011/0019420 | A1* | 1/2011 | Kadotani et al. | 362/249.03 |
| 2012/0038271 | A1* | 2/2012 | Lu et al. | 315/32 |
| 2012/0306366 | A1* | 12/2012 | Sakai et al. | 315/51 |
| 2013/0039095 | A1* | 2/2013 | Lee et al. | 362/640 |
| 2013/0044500 | A1* | 2/2013 | Reingruber | 362/382 |

FOREIGN PATENT DOCUMENTS

| | | | |
|---|---|---|---|
| CN | 202140856 U | * | 2/2012 |
| CN | 202791463 U | * | 3/2013 |

OTHER PUBLICATIONS

English abstract of CN202140856 to Wen.*
English translation of CN 202140856 to Wen.*
Machine English translation of CN 202791463 to Lin.*

* cited by examiner

*Primary Examiner* — Sikha Roy
(74) *Attorney, Agent, or Firm* — Francis C. Hand; Carella, Byrne, et al.

(57) ABSTRACT

The LED bulb has a body of silicone between the LED driver and the heat sink for transferring heat generated in the LED driver to the heat sink. The body of silicone is also disposed between the LED module and heat sink for transferring heal generated in the LED module to the heat sink.

10 Claims, 2 Drawing Sheets

LED BULB WITH HEAT SINK

This invention relates to a LED bulb. More particularly, this invention relates to a LED bulb with a heat sink.

As is known, light-emitting diodes (LEDs) have been used for lighting in various environments, such as displays for low light environments in modems, wristwatches and the like. U.S. Pat. No. 6,211,626 discloses the use of an LED system in a cooled display case and in vending machines.

As described in U.S. Pat. Nos. 6,864,513; 7,347,589; 8,226,272; 8,246,215 and 8,328,394, operation of an LED bulb generates heat that can cause a degradation of the quality of the illumination provided by the bulb. Further, the rate of heat generation increases with the illumination intensity. Consequently, LED bulbs have been provided with a heat sink to absorb the heat from the LEDs and to dissipate the heat to the surrounding environment, such as by having a flow of ambient air pass over a ribbed surface of the heat sink.

In some cases, in order to provide a high brightness, a reflector is mounted on the LED bulb to cover the heat sink, whereby light generated by the LEDs is repeatedly reflected by the reflector downwardly. However, ambient air around the heat sink is heated to flow upwardly, and then accumulates at a top of the reflector, making dissipation of the heat problematic.

Generally, the use of LED bulbs has been limited to environments where the ambient temperatures are not high.

Accordingly, it is an object of the invention to provide a LED bulb for operating in an environment at elevated temperatures.

It is another object of the invention to provide a LED bulb for mounting above a heated cooking surface.

It is another object of the invention to provide a LED bulb for operation at temperatures of 75° C. above a heated cooking surface.

Briefly, the invention is directed to a LED bulb having a LED driver: a LED module (chip) electrically connected to the LED driver; a plurality of light emitting diodes electrically connected to the LED module for illumination thereby and a heat sink surrounding the LED driver and LED module.

In accordance with the invention, a body of silicone is disposed between the LED driver and the heat sink for transferring heat generated in the LED driver to the heat sink. The body of silicone is also disposed between the LED module and the heat sink for transferring heat generated in LED module to the heat sink.

Figure 1:
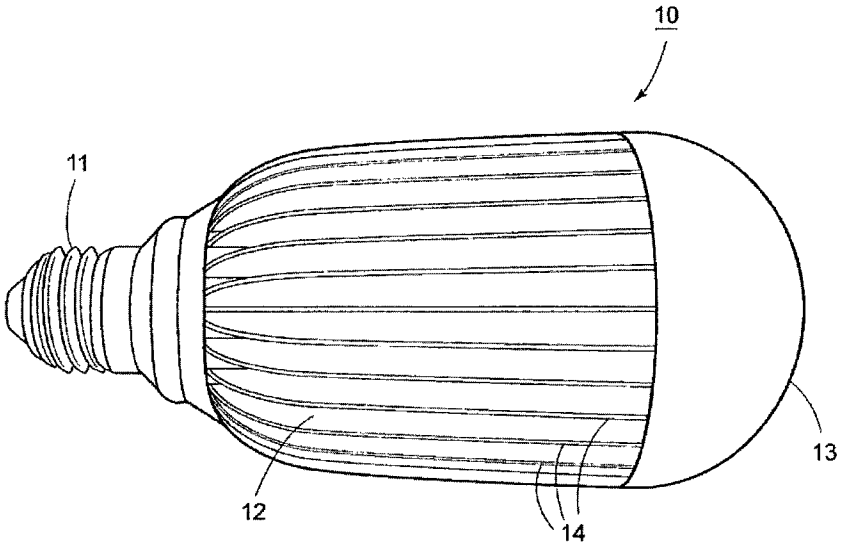
Figure 2:
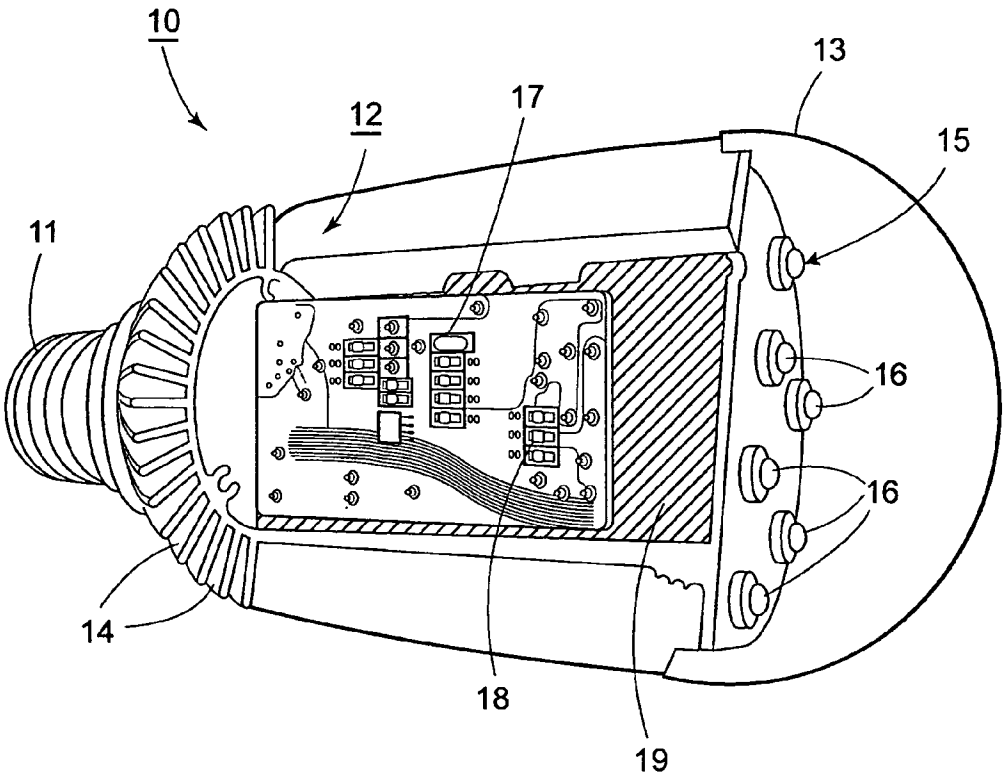

These and other objects of the invention will become more apparent from the following detailed description taken in conjunction with the accompanying drawings in which:

FIG. 1 illustrates a front view of a LED bulb constructed in accordance with the invention; and FIG. 2 illustrates a broken perspective view of the LED bulb of FIG. 1.

Referring to FIG. 1, the LED bulb 10 is constructed with conventional components, such as, a threaded plug 11 for threading into a suitable socket (not shown) selectively connected to a source of electricity (not shown), a heat sink 12 and a lens 13.

As indicated, the heat sink 12 is made of aluminum and is provided with a circumferential array of spaced apart ribs 14 for channeling a flow of ambient air thereover. The heat sink 11 acts as a housing for the contents of the bulb 10.

The lens 13 is of hemispherical shape and of a transparent nature to pass light therethrough Referring to FIG. 2, wherein like reference characters indicate like parts as above, the LED bulb 10 includes an LED module 15 (i.e. chip) having an array of light emitting diodes (LEDs) 16 thereon and a LED driver 17. The diodes 16 are sized to provide light at low energy levels while providing long hours of use, e.g. 50,000 hours.

The LED module 15 is of conventional structure and is mounted so that the LEDs 16 may project light through the lens 13 when energized by the LED driver 17.

The LED driver 17 is of conventional structure and is electrically connected via suitable wires 18 to the LEDs 16.

As illustrated, the heat sink 12 is of hollow tubular shape and surrounds the LED driver 17 and the LED module 15 in order to dissipate heat generated by the LED driver 17 and LED module 15 when in operation.

The LED bulb 10 also includes a body of silicone 19 between the LED driver 17 and heat sink 12 and between the base of the LED module 15 and heat sink 12 for transferring heat generated in the LED driver 17 and LED module 15 to the heat sink 12.

During assembly of the bulb 10, after placement of the LED driver 17 and LED module 15 within the heat sink 12, a flowable silicone material, such as semi-liquid silicone, is flowed into the space between the LED driver 17 and heat sink 12 filling the space and encapsulating the LED driver 17 and wires 18 while also flowing between the base of the LED module 15 and the heat sink 12. Upon curing, the silicone hardens and forms the body 19. As illustrated, the silicone body 19 circumferentially surrounds the driver 17 and is disposed between the LED module 15 and the LED driver 17.

When the bulb 10 is energized, the heat generated in the LED driver 17 is transferred by the surrounding body of silicone 19 to the heat sink 12. In like manner, the heat generated in the LED module 15 is transferred by the underlying body of silicone 19 to the heat sink 12.

The bulb 10 may be mounted in an overhead canopy hood of a stove in order to provide illumination while operating at an elevated temperature. For example, the diodes 16 of the LED module 15 provide lighting equivalent to a 150 Watt incandescent bulb while operating in an environment at temperatures of up to 75° C.

The invention thus provides LED bulb that is able to direct clean efficient light to a work surface in a cost effective manner as compared to incandescent light.

The LED bulb is particularly useful in canopy lighting units employed over stoves and the like.

The invention further provides an LED bulb that can be retrofitted into existing canopies under stoves in a commercial kitchen, that can be easily cleaned, that generates low heat and that has an extended life.

What is claimed is:

1. A LED bulb comprising a LED driver;

a LED module electrically connected to said LED driver;

a plurality of light emitting diodes electrically connected to said LED module for illumination thereof;

a heat sink surrounding said LED driver and said LED module; and a body of silicone between and in contact with said LED driver and said heat sink for transferring heat generated in said LED driver from said LED driver to said heat sink, said body of silicone being between and in contact with said LED module and said heat sink for transferring heat generated in said LED module from said LED module to said heat sink.

2. A LED bulb as set forth in claim 1 wherein said heat sink is made of aluminum.

3. A LED bulb as set forth in claim 2 wherein said heat sink 12 is of hollow tubular shape with a circumferential array of spaced apart ribs for channeling a flow of ambient air thereover.

4. A LED bulb comprising a LED driver;

a LED module electrically connected to said LED driver;

a plurality of light emitting diodes electrically connected to said LED module for illumination thereof;

a heat sink of aluminum surrounding said LED driver and having a circumferential array of spaced apart ribs for channeling a flow of ambient air thereover;

a body of silicone circumferentially surrounding said LED driver and disposed between said LED driver and said heat sink for transferring heat generated in said LED driver from said LED driver to said heat sink, said body of silicone being between and in contact with said LED module and said heat sink for transferring heat generated in said LED module from said LED module to said heat sink.

5. A LED bulb comprising a LED driver;

a LED module;

a plurality of wires electrically connecting said LED driver to said LED module;

a plurality of light emitting diodes electrically connected to said LED module for illumination thereof;

a heat sink of aluminum for dissipating heat generated by said LED driver and said LED module during operation thereof; and a body of silicone circumferentially surrounding said LED driver and said wires and being disposed between and in contact with said LED driver and said heat sink for transferring heat generated in said LED driver from said LED driver to said heat sink.

6. A LED bulb as set forth in claim 5 wherein said body of silicone is disposed between said LED module and said heat sink for transferring heat generated in said LED module from said LED module to said heat sink.

7. A LED bulb as set forth in claim 5 wherein said heat sink is of hollow tubular shape and houses said LED driver therein.

8. A LED bulb comprising a plug at one end for connection to a source of electricity;

a lens at an opposite end from said plug;

a heat sink of aluminum extending between said plug and said lens and including a circumferential array of spaced apart ribs;

a LED driver within said heat sink;

a LED module within said lens;

a plurality of wires electrically connecting said LED driver to said LED module;

a plurality of light emitting diodes electrically connected to said LED module for illumination thereof; and a body of silicone circumferentially surrounding said LED driver and said wires and being disposed between and in contact with said LED driver and said heat sink for transferring heat generated in said LED driver from said LED driver to said heat sink.

9. A LED bulb as set forth in claim 8 wherein said body of silicone is disposed for transferring heat generated in said LED module from said LED module to said heat sink.

10. A LED bulb as set forth in claim 8 wherein said plug is threaded.

* * * * *